United States Patent [19]

Speak et al.

[11] 4,425,079

[45] Jan. 10, 1984

[54] AIR SEALING FOR TURBOMACHINES

[75] Inventors: Trevor H. Speak, Gloucester; John D. Kernon; Derek A. Roberts, both of Bristol, all of England

[73] Assignee: Rolls-Royce Limited, London, England

[21] Appl. No.: 286,967

[22] Filed: Jul. 27, 1981

[30] Foreign Application Priority Data

Aug. 6, 1980 [GB] United Kingdom ..... 8025692

[51] Int. Cl.[3] ..... F01D 5/08

[52] U.S. Cl. ..... 415/139; 416/95; 415/115; 415/180

[58] Field of Search ..... 415/115, 116, 136, 138, 415/139, 180; 416/95

[56] References Cited

U.S. PATENT DOCUMENTS 3,635,586 1/1972 Kent et al. ..... 415/115 X
4,086,757 5/1978 Karstensen et al. ..... 415/115 X
4,127,357 11/1978 Patterson ..... 415/116
4,306,834 12/1981 Lee ..... 415/116

FOREIGN PATENT DOCUMENTS 2030993 11/1970 France .
1476237 6/1977 France .
1242787 8/1971 United Kingdom .

*Primary Examiner*—Philip R. Coe
*Assistant Examiner*—Arthur D. Dahlberg
*Attorney, Agent, or Firm*—Parkhurst & Oliff

[57] ABSTRACT

A stator assembly for a turbomachine having a sealing plate which co-operates with sealing members on an adjacent rotor assembly to form air seals. The sealing plate is provided with a thermal slugging mass, the thermal response of which controls the rate of expansion and contraction of the sealing plate to match that of the rotor. In this way tip clearances between the stationary and rotating parts of the air seals are maintained substantially uniform throughout all operating conditions of the turbomachine.

9 Claims, 3 Drawing Figures

AIR SEALING FOR TURBOMACHINES

DESCRIPTION

This invention relates to stator structures for turbomachines which incorporate air seals formed between a sealing plate and a rotor assembly.

There are instances in the design of, for example, a turbine of a turbo machine, where the rotor is provided with one or more projections spaced closely from a surface on a static sealing plate to form an air seal to minimise the leakage of cooling air radially into the flow passage of the working fluid of the turbine. In use the rotor becomes heated and expands radially relative to the static structures. In prior known designs this expansion is accommodated by increasing the initial gap between the co-operating parts of the rotor and the sealing plate so that the parts do not contact each other on expansion. Therefore in these known designs optimum sealing is only achieved when the rotor attains a predetermined temperature. At other rotor temperatures the gap is either too large, and hence not an efficient seal, or too small in which case the rotating parts may touch and damage the static parts.

An object of the present invention is to design a stator assembly for a turbomachine so that, in use, its thermal expansion and contraction resemble that of the rotor assembly. In this way it is hoped that an effective air seal is maintained between co-operating parts of the stator assembly and the rotor during all modes of operation of the turbomachine.

According to the present invention there is provided a stator assembly for a turbomachine comprising a stator vane assembly which defines an annular flow passage, an annular sealing plate carried by the stator vane assembly but moveable radially relative to the stator vane assembly, the sealing plate being provided with one or more surfaces which co-operate with one or more surfaces on a rotor assembly adjacent to the sealing plate to define an air seal which reduces the flow of air radially outwards towards the annular flow passage, the sealing plate being provided with a thermal slugging mass shaped, constructed and arranged so that in use its thermal response controls the rate of thermal expansion and contraction of the sealing plate in radial directions to match the rate of thermal expansion and contraction of the rotor assembly in radial directions and thereby control the spacing between the surfaces on the seal plate and the rotor assembly that co-operate to define the air seal.

Preferably the sealing plate is segmented so that it can move in radial directions without undue constraint.

Embodiments of the present invention will now be described, by way of examples, with reference to the accompanying drawings in which.

Figure 1:
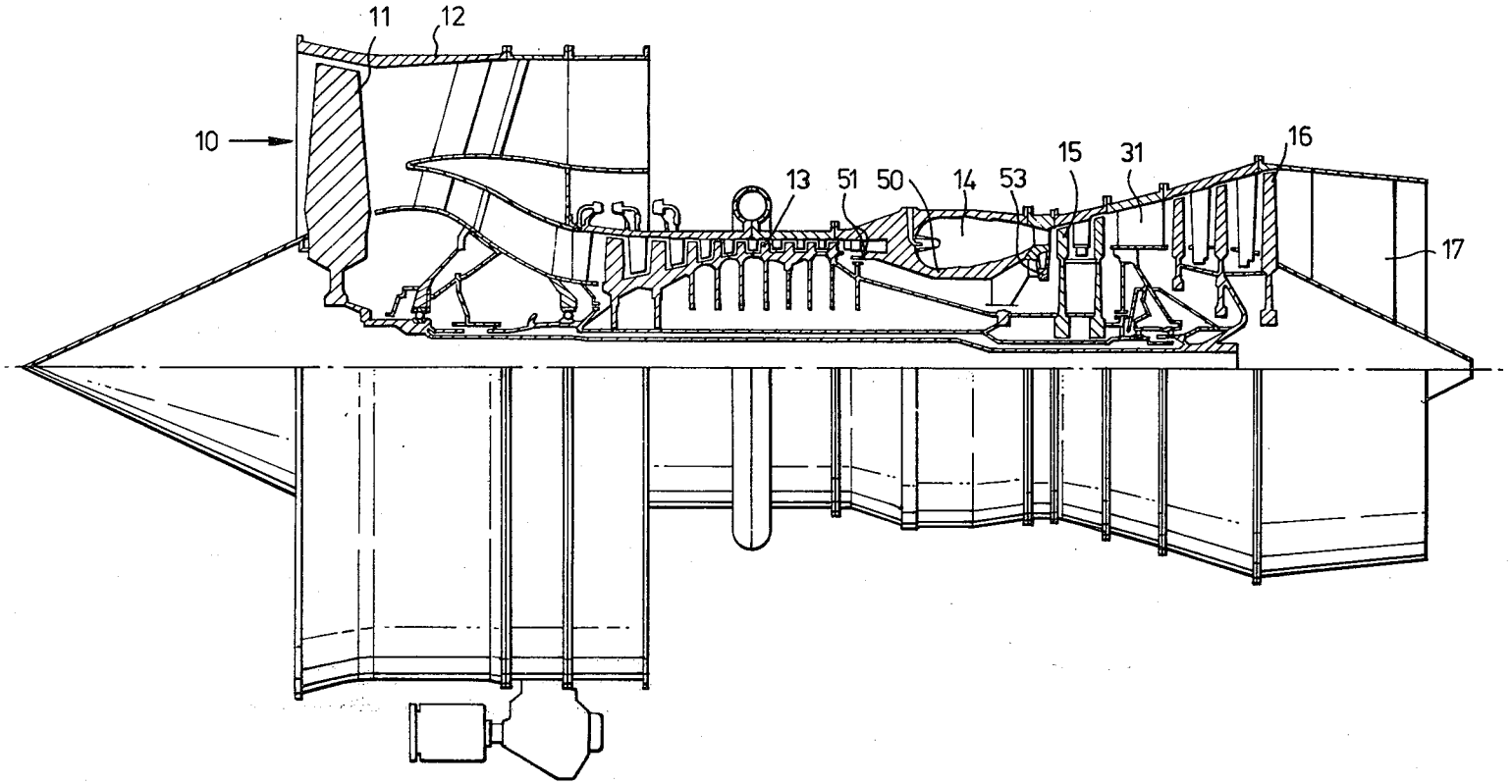
FIG. 1 is a schematic representation of a multi-spool gas turbine aero-engine of the bypass type incorporating a stator assembly constructed in accordance with the present invention.

Referring to FIG. 1 there is shown a gas turbine aero engine 10 comprising a low pressure single stage compressor fan 11 mounted in a bypass duct 12 and a core engine which comprises, in flow series, a multi-stage high pressure axial flow compressor 13, a combustion chamber 14, a two-stage high pressure turbine 15, a multi-stage low pressure turbine 16, and a jet pipe.

Figure 2:
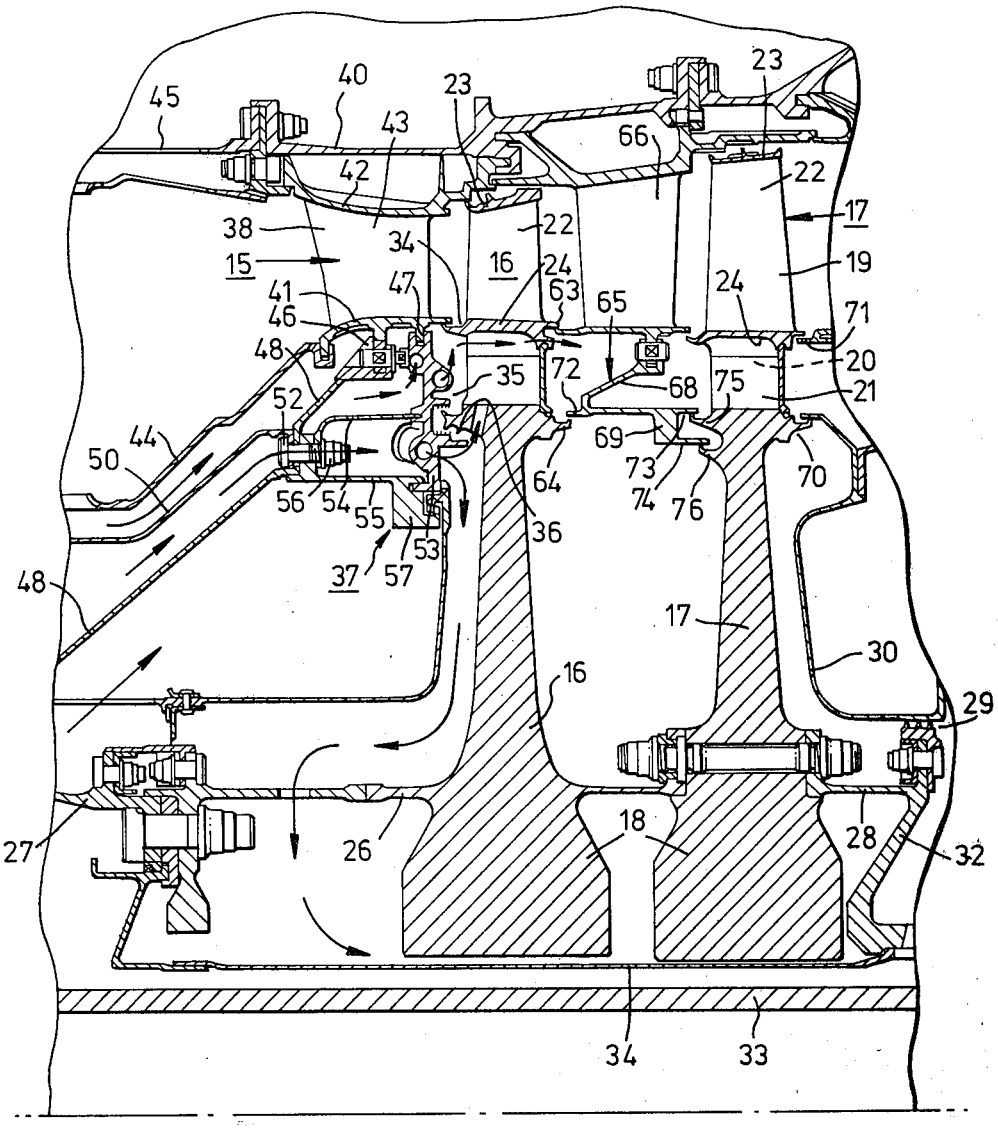
FIG. 2 is a sectional view through part of the first stage of the HP turbine of FIG. 1.

Referring in particular to FIG. 2 the high pressure turbine 15 comprises a turbine rotor assembly consisting of two turbine stages. Each turbine stage itself comprises an annular turbine disc 16,17 which has a large central cob 18 and a plurality of equi-spaced turbine blades 19 around the rim of the disc.

Each disc 16,17 is provided with equi-spaced blade fixing slots 20 of well-known fir-tree-root fixing type, and each blade 19 comprises a fir tree root 21 which locates in, and is retained by the slots 20 in each disc 16,17. The blades 19 have an aerofoil shaped section 22, a tip shroud 23, a platform 24 and a shank 25 between the platform 24 and the fir tree root.

The first stage turbine disc 16 is provided with a flange 26 by which it is secured to the HP compressor shaft 27. The first stage turbine disc 16 is bolted to the second stage turbine disc 17 which is provided with a rearward projecting flange 28 which forms part of a labyrinth seal 29. The labyrinth seal 29 co-operates with fixed structure 30 carried by the inlet guide vane assembly 31 of the LP turbine. The shaft 27 is supported by means of a connecting member 32 for rotation in a journal bearing (not shown).

The shaft 33 connecting the LP compressor to the LP turbine extends through the central bore in the discs 16,17 and a cover tube 34 extends between the member 32 and the HP compressor shaft 27 to provide an airtight cover over the shaft 33.

The first stage turbine disc 16 is provided with three members 34,35,36 on its upstream side each of which has a surface that co-operates with a surface on an adjacent part of a stator assembly 37, constructed in accordance with the present invention to define air seals.

The stator assembly 37 comprises a segmented inlet guide vane assembly 38 mounted in the turbine outer casing 40. The segments of the guide vane assembly each have an inner and outer platform 41,42 interconnected by a plurality of aerofoil shaped guide vanes 43 to define an annular flow passage.

The inner platform 41 supports the inner wall of an annular combustion chamber 44 (the outer wall of the combustion chamber 44 is carried by the outer casing 45). The inner platform has two flanges 46,47 projecting radially inwards. The flange 46 locates in an outer circumferential recess in a wall structure 48 that serves to define a number of separate flow paths for cooling air. The wall structure 48 is held in place by a pin 49 which allows relative radial movement between the wall structure 48 and the guide vane assembly.

Bolted to the wall structure 48 is the combustion chamber inner casing 50. This casing encompasses the inner regions of the combustion chamber 44 and is supported at its upstream end by the outlet nozzle guide vane and diffuser assembly 51 of the HP compressor 13 (see FIG. 1). The bolts 52 are used to clamp a sealing plate 53 to the wall structure 48.

The sealing plate 53 is annular and comprises a plurality of segments. The radially extending gaps between the segments are sealed either by overlapping the segments or by means of a thin plate carried by each segment. The outer circumference of the sealing plate 53 is provided with a recess into which the flange 47 on the inner platform of the guide vane assembly locates. The sealing plate 53 has two recesses into each of which a thin wall web 54,55 locates. The webs project forward from the plane of the plate 53 and are bolted to the wall structure 48 by the bolts 52 and nuts 56.

The web 55 is provided with a large mass 57 at its end adjacent the inner circumference of the sealing plate 53, and a recess is provided in the mass 57 into which fits a flange on the sealing plate 53. The mass 57 thus effectively constitutes a thermal slugging mass for the sealing plate and is dimensioned, shaped, and arranged relative to the disc 16 and made of a suitable material in relation to the disc that, in use, its thermal expansion and contraction in radial directions controls the radial movements of the plate 53 to match the radial movements of the disc 16.

Figure 3:
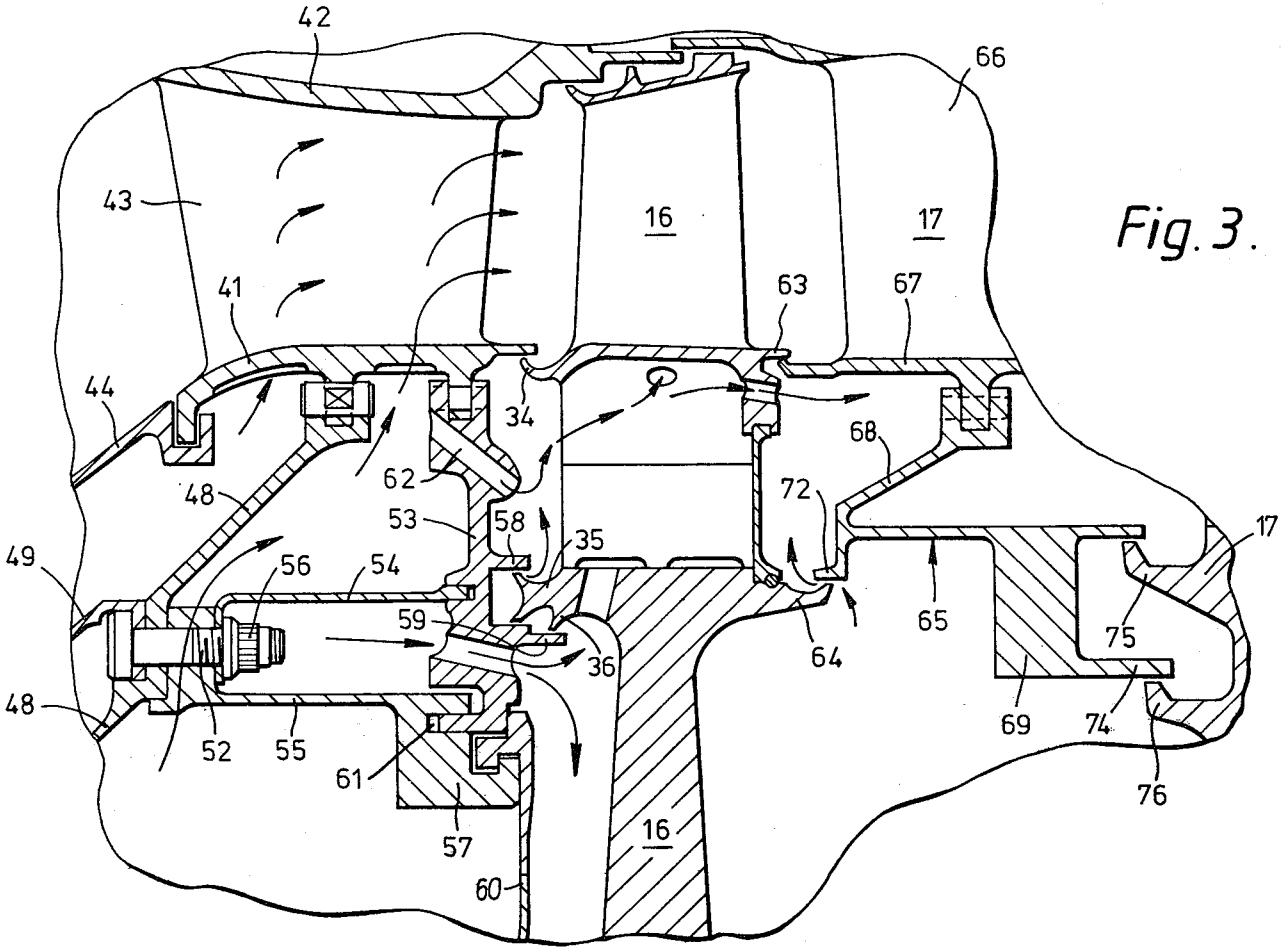
FIG. 3 illustrates in greater detail a sealing plate of one of the stator assemblies shown in FIG. 2.

The sealing plate 53 has two concentric flanges 58,59 projecting towards the disc 16 (see FIG. 3).

These flanges 58,59 have surfaces which confront, and co-operate with, surfaces on the members carried by the disc to define air seals (the function of which will be described later). By controlling the radial movements of the sealing plate 53 to match that of the rotor disc 16, the clearances between the co-operating surfaces that define the air seal can be maintained to provide optimised performance of the seal.

The mass 57 has a recess in to which locates a cover plate 60 which covers the upstream face of disc 16.

The wall structure 48 and webs 54,55 define three separate chambers and hence separate flow paths for cooling air. The first flow is ducted between the combustion chamber 44 and inner casing 49 through cavities within the guide vanes 43 to issue from holes in the surface of the vanes. The second flow is ducted via the space between the inner casing 50 and wall structure 48, through aperture between 52 bolts to issue through nozzles 61 in the sealing plate 53 inboard of the air seal. This air flow is used to cool the turbine blades as described in our copending British patent application No. 46540/78 and cool the disc 16. The third flow is ducted via the space between the HP shaft and wall structure 48, though radial holes in the flange of web 55 between the bolts 52 to issue from nozzles 62 radially outboard of the air seal. This air is transferred through channels and nozzles in the turbine disc 16 as described in our copending patent application No. 7930150.

The nozzles 61 may be directed parallel to the axis of rotation of the disc or radially inwards or outwards. It is preferred to direct the nozzles 61 in the same direction as the direction as the rotor to impart a swirl to the air in the same direction that the rotor rotates In this way it is thought that energy will be extracted from the air to further cool it and at the same time the forced vortex will cause part of the air to move radially inwards, against centrifugal forces on the air, in the space between the cover plate and the rotor 16. This cooling air is ducted through the central bore of the discs 16,17 and used to pressurise the inner disc rim seals 70,71.

The disc 16 is provided with two sealing members 63, 64 which have surfaces that co-operate with a stator assembly 65 located between the two turbine rotor discs 16,17. The stator assembly 65 comprises a segmented inlet guide vane assembly 66 of the second H.P. turbine stage and the guide vane assembly 66 is mounted at its outer periphery in the outer casing 40 of the turbine.

The guide vane assembly segments have an inner platform 67 which has a spigot which locates in the outer circumferential recess of a second sealing plate 68. The second sealing plate 68 is generally annular and has an integral mass 69 which performs a similar function to that of mass 57. The sealing plate has a cylindrical flange 72 that has a surface that co-operates with a surface on the seal member 64 on the first stage turbine disc 16 and has two radially spaced cylindrical flanges 73,74 which have surfaces co-operating with surfaces on sealing members 75,76 provided on the upstream face of the second stage turbine disc 17.

The mass 69 is shaped dimensioned and arranged so that its thermal response controls the radial movement of the sealing plate 68 to match that of the discs 16 and 17 to control the air seal clearances.

It will be seen that the sealing plate 68 is of a "V" shape in cross section to provide flexibility in radial directions. The sealine plate 68 is not segmented.

We claim:

1. A stator assembly for a turbomachine comprising a stator vane assembly which defines an annular flow passage, an annular sealing plate carried by the stator vane assembly but moveable radially relative to the stator vane assembly, the sealing plate being provided with one or more surfaces which co-operate with one or more surfaces on a rotor assembly adjacent to the sealing plate to define an air seal which reduces the flow of air radially outwards towards the annular flow passage, the sealing plate being provided with a thermal slugging mass shaped, constructed and arranged so that in use its thermal response controls the rate of thermal expansion and contraction of the sealing plate in radial directions to match the rate of thermal expansion and contraction of the rotor assembly in radial directions and thereby control the spacing between the surfaces on the seal plate and the rotor assembly that co-operate to define the air seal.

2. A stator assembly according to claim 1 wherein the sealing plate is segmented.

3. A stator assembly according to claim 1 wherein the sealing plate co-operates with other structure to define two chambers on that side of the sealing plate remote from the rotor assembly, the sealing plate has two nozzle means which communicates with each chamber and the nozzle means are directed towards the rotor assembly for the purpose of directing cooling air admitted to each chamber towards the rotor, the nozzle means communicating with one of the chambers being located radially outboard of the air seal and the nozzle means of the other chamber being located radially inboard of the air seal.

4. A stator assembly according to claim 3 wherein at least one of the nozzle means is directed with a radially inward component.

5. A stator assembly according to claim 2 or claim 3 wherein at least one of the nozzle means is directed in the direction of rotation of the rotor assembly thereby to preswirl the air issuing from the nozzle means.

6. A stator assembly according to claim 1 wherein the thermal slugging mass is provided at the inner circumference of the sealing plate.

7. A stator assembly according to claim 1 preceding claims wherein the thermal slugging mass is a separate body to that of the seal plate and is provided with a recess into which a part of the seal plate is located, and thermal slugging mass is connected to fixed structure of the turbomachine by means of a flexible member that allows radial movement of the thermal slugging mass and the seal plate relative to the fixed structure.

8. A stator assembly according to claim 7 wherein the seal plate is connected to fixed structure of the turbomachine by means of a second flexible member which allows radial movement of the seal plate and the thermal slugging mass relative to the fixed structure.

9. A stator assembly according to claim 1 wherein the thermal slugging mass and the seal plate are an integral unitary body and the seal plate is connected to fixed structure of the turbomachine by means of a flexible member which allows radial movement of the seal plate and thermal slugging mass.

* * * * *